US006136112A

United States Patent [19]

Blomquist

[11] Patent Number: 6,136,112

[45] Date of Patent: Oct. 24, 2000

[54] SMOKELESS GAS GENERATING COMPOSITION FOR AN INFLATABLE VEHICLE OCCUPANT PROTECTION DEVICE

[75] Inventor: Harold R. Blomquist, Gilbert, Ariz.

[73] Assignee: TRW Inc., Lyndhurst, Ohio

[21] Appl. No.: 09/426,611

[22] Filed: Oct. 26, 1999

[51] Int. Cl.[7] ..... C06B 45/10; C06B 31/00; C06B 31/28; B60R 21/28

[52] U.S. Cl. ..... 149/19.4; 149/19.6; 149/46; 149/45; 280/741

[58] Field of Search ..... 149/46, 45, 19.4, 149/19.6

[56] References Cited

U.S. PATENT DOCUMENTS

| | | | |
|---|---|---|---|
| Re. 36,296 | 9/1999 | Zeigler | 149/47 |
| 4,764,586 | 8/1988 | Manser et al. | 149/19.4 |
| 4,988,797 | 1/1991 | Wardle et al. | 528/408 |
| 5,210,153 | 5/1993 | Manser et al. | 255/410 |
| 5,214,166 | 5/1993 | Manser et al. | 549/510 |
| 5,507,891 | 4/1996 | Zeigler | 149/47 |
| 5,540,794 | 7/1996 | Willer et al. | 149/19.8 |
| 5,589,661 | 12/1996 | Menke et al. | 149/19.4 |
| 5,641,938 | 6/1997 | Holland et al. | 149/48 |
| 5,663,289 | 9/1997 | Archilbald et al. | 528/414 |
| 5,695,216 | 12/1997 | Sandstrom et al. | 280/737 |
| 5,783,773 | 7/1998 | Poole | 149/36 |
| 5,889,161 | 3/1999 | Bottaro et al. | 149/55 |

*Primary Examiner*—Charles T. Jordan
*Assistant Examiner*—Glenda L. Sánchez
*Attorney, Agent, or Firm*—Tarolli, Sundheim, Covell, Tummino & Szabo L.L.P.

[57] ABSTRACT

An apparatus comprises an inflatable vehicle occupant protection device (20) and a gas generating composition (16). The gas generating composition (16), when ignited, produces gas to inflate the inflatable vehicle occupant protection device (20). The gas generating composition comprises an oxidizer and an energetic binder system. The energetic binder system comprises at least 90% by weight of a thermoplastic elastomer and from 0 to about 10% of a component selected from the group consisting of a plasticizer, a burn rate modifier, a processing aid and combinations thereof. The thermoplastic elastomer is a copolymer of bis-3,3-nitratomethyl-oxtane (BNMO) and nitratomethy-methyl-oxetane (NMMO).

7 Claims, 1 Drawing Sheet

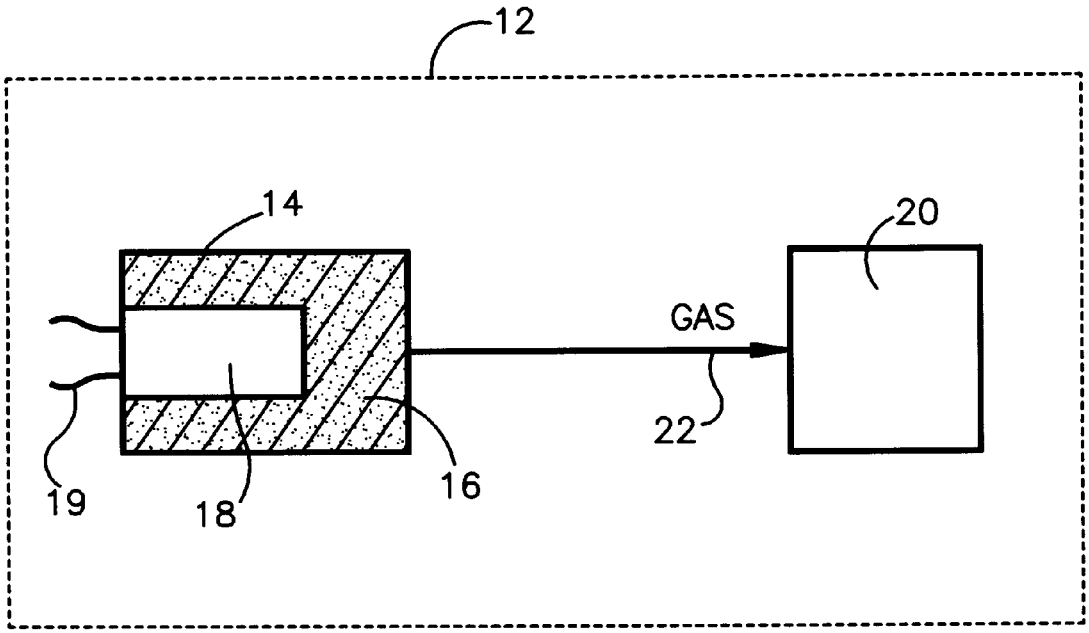
12
14
20
GAS
22
19
18
16

SMOKELESS GAS GENERATING COMPOSITION FOR AN INFLATABLE VEHICLE OCCUPANT PROTECTION DEVICE

FIELD OF THE INVENTION

The present invention relates to an apparatus comprising an inflatable vehicle occupant protection device and a gas generating composition for providing inflation gas for inflating the inflatable vehicle occupant protection device.

BACKGROUND OF THE INVENTION

An inflatable vehicle occupant protection device, such as an air bag, is inflated by gas provided by an inflator. The inflator contains a body of ignitable gas generating material. The inflator further includes an igniter. The igniter is actuated so as to ignite the body of gas generating material when the vehicle experiences a collision for which inflation of the air bag is desired. As the body of gas generating material burns, it generates a volume of inflation gas. The inflation gas is directed into the vehicle air bag to inflate the air bag. When the air bag is inflated, it expands into the vehicle occupant compartment and helps to protect the vehicle occupant.

A convenient way of making gas generating material is by extrusion. Gas generating material which is extruded can be configured into a variety of shapes, including rods, channels, and other structural shapes suitable for use in various types of inflators.

It is desirable that gas generating material for inflating an inflatable vehicle occupant protection device produces, upon combustion, an inflation gas which is substantially smoke-free and substantially free of toxic materials. Gas generating material which is extruded includes an oxidizer and a cross-linked elastomeric polymer. Since conventional cross-linked elastomeric polymers used in extrusion processing have a low oxygen content, either an oxidizer containing a high amount of oxygen or a high oxidizer content is required in the gas generating material. Alternatively, gaseous oxygen may be used in the inflator to convert the carbon in the gas generating material fully to carbon dioxide during combustion.

Several energetic elastomeric polymers have a high oxygen content capable of converting the carbon in the gas generating composition to carbon dioxide during combustion. However these energetic elastomeric polymers fail to meet other gas generating material requirements including mechanical integrity over a wide temperature range, chemical stability and safety.

U.S. Pat. No. 5,540,794 discloses an energetic binder useful for making thermoplastic elastomer low vulnerability ammunition propellants and energetic compositions which comprise at least one energetic thermoplastic elastomer binder, at least one plasticizer, and nitrocellulose.

SUMMARY OF THE INVENTION

The present invention resides in an apparatus comprising an inflatable vehicle occupant protection device and a gas generating composition for providing inflation gas for inflating the inflatable vehicle occupant protection device. The gas generating composition comprises an oxidizer and an energetic binder system. A preferred oxidizer is phase stabilized ammonium nitrate. The energetic binder system is a mixture of at least 90% by weight of a thermoplastic elastomer and from 0 to about 10% of a component selected from the group consisting of a plasticizer, a burn rate modifier, processing aids, and combinations thereof. The thermoplastic elastomer is a copolymer of bis-3,3-nitratomethyl-oxetane (BNMO) and nitratomethyl-methyl-oxetane (NMMO).

BRIEF DESCRIPTION OF THE DRAWINGS

Further features of the present invention will become apparent to those skilled in the art to which the present invention relates, from consideration of the following specification, with reference to the accompanying drawing which is a schematic illustration of an apparatus embodying the present invention.

DESCRIPTION OF PREFERRED EMBODIMENTS

Referring to the FIGURE, an apparatus 12 embodying the present invention comprises an inflator 14. The inflator 14 contains a gas generating material 16. The gas generating material 16 is ignited by an igniter 18 operatively associated with the gas generating material 16. Electric leads 19 convey current to the igniter 18 from a sensor which is responsive to a vehicle collision. The apparatus 12 also comprises a vehicle occupant protection device 20. A gas flow means 22 conveys gas which is generated by combustion of the gas generating material 16 in the inflator 14 to the vehicle occupant protection device 20.

A preferred vehicle occupant protection device 20 is an air bag which is inflatable to protect a vehicle occupant in the event of a collision. Other vehicle occupant protection devices which can be used in the present invention are inflatable seat belts, inflatable knee bolsters, inflatable air bags to operate knee bolsters, inflatable head liners and/or inflatable side curtains.

The gas generating composition of the present invention comprises an oxidizer and an energetic binder system. The energetic binder system includes at least 90% by weight of a thermoplastic elastomer. The thermoplastic elastomer is a copolymer of a hard block monomer and a soft block monomer. In the present invention the hard block monomer is bis-3,3-nitratomethyl-oxetane (BNMO) and the soft block monomer is nitratomethyl-methyl-oxetane (NMMO).

The thermoplastic elastomer of the present invention can have various configurations including as an $(AB)_n$ polymer, an ABA polymer and an $A_nB$ polymer, where A is the hard block monomer, B is the soft block monomer, and n is an integer greater than one. Preferably the thermoplastic elastomer is configured as an $(AB)_n$ polymer.

The energetic binder system also includes from about 0 to about 10% of a component selected from the group consisting of a plasticizer, a burn rate modifier, processing aids, and combinations thereof. Preferably, a plasticizer is not used.

Preferably, the energetic binder system of the present invention is generally a resilient solid, like a hard rubber, capable of withstanding shock without permanent deformation at 85° C. and not brittle at −40° C.

The amount of energetic binder system in the gas generating composition is that amount necessary to achieve sustained combustion of the gas generating composition. A preferred amount of the energetic binder system is in the range of about 20% to about 45% based on the combined weight of the energetic binder system and the oxidizer.

The oxidizer in the gas generating composition of the present invention can be any inorganic oxidizer. A preferred oxidizer is ammonium nitrate. Other oxidizers that can be used are potassium nitrate, potassium perchlorate, ammonium perchlorate, and combinations thereof.

When ammonium nitrate is used as the oxidizer, the ammonium nitrate is preferably phase stabilized. The phase stabilization of ammonium nitrate is well known. In one method, the ammonium nitrate is doped with an alkali metal or alkaline earth metal cation in an amount which is effective to minimize the volumetric and structural changes associated with the Phase IV →← Phase III transitions inherent to pure ammonium nitrate. Other useful phase stabilizers include potassium salts such as potassium dichromate, potassium oxalate, and mixtures thereof. Ammonium nitrate can also be stabilized by doping with copper and zinc ions. Other compounds, modifiers, and methods that are effective to phase stabilize ammonium nitrate are well known and suitable in the present invention.

The weight ratio of the oxidizer to the energetic binder system is that weight ratio effective to provide a combustion gas product that is substantially free of carbon monoxide; that is, wherein the carbon in the energetic binder is substantially or completely oxidized to carbon dioxide. Preferably, the amount of oxidizer in the gas generating composition is in the range of about 55% to about 80% based on the combined weight of the energetic binder system and the oxidizer.

EXAMPLE

A gas generating composition consisting of 79% by weight ammonium nitrate (AN) and 21% by weight of a copolymer of bis-3,3-nitratomethyl-oxetane (BNMO) and nitratomethyl-methyl-oxetane (NMMO) was prepared by blending ammonium nitrate and a copolymer of bis-3,3-nitratomethyl-oxetane and nitratomethyl-methyl-oxetane in an ethyl acetate solvent. The resultant slurry was added to a twin screw extruder and extruded as a solid in a predetermined shape. The shape is dependent upon the die used during extrusion. The solid was cut into pieces with a water jet cutter and dried at 120° F. until the remaining solvent was removed.

The calculated combustion temperature and exhaust temperature for the gas generating material were 2671° C. and 1196° C., respectively. The gas generating material produced 4.11 mols of gas per 100 grams of the gas generating material. The major gas products were carbon dioxide, nitrogen, and water.

The present invention takes advantage of the favorable performance characteristics of using a copolymer of bis-3,3-nitratomethyl-oxetane (BNMO) and nitratomethyl-methyl-oxetane (NMMO) and an oxidizer in a gas generating composition for providing inflation gas for inflating an inflatable vehicle occupant protection device. A gas generating composition which comprises a copolymer of bis-3,3-nitratomethyl-oxetane and nitratomethyl-methyl-oxetane and an oxidizer can be easily processed by extrusion because the composition forms a resilient solid, like a hard rubber, without the addition of a plasticizer. Furthermore, the gas generating composition of the present invention produces a gas product which is essentially nontoxic and free of particulates. Also, the gas generating composition of the present invention has good mechanical stability over a wide temperature range. The improvements in mechanical stability and quality of the gas product accrue from the use of less oxidizer for complete combustion of the carbon in the gas generating composition to carbon dioxide.

From the above description of the invention, those skilled in the art will perceive improvements, changes and modifications. Such improvements, changes and modifications within the skill of the art are intended to be covered by the appended claims.

Having described the invention, the following is claimed:

1. An apparatus comprising an inflatable vehicle occupant protection device and a gas generating composition which, when ignited, produces gas to inflate said inflatable vehicle occupant protection device, said gas generating composition comprising:

an oxidizer, and an energetic binder system comprising at least 90% by weight of a thermoplastic elastomer and from 0 to about 10% of a component selected from the group consisting of a plasticizer, a burn rate modifier, a processing aid, and combinations thereof, wherein said thermoplastic elastomer is a copolymer of bis-3,3-nitratomethyl-oxetane (BNMO) and nitratomethyl-methyl-oxetane (NMMO).

2. The apparatus as defined in claim 1 wherein said oxidizer is selected from the group consisting of phase stabilized ammonium nitrate, ammonium perchlorate, potassium perchlorate, potassium nitrate, and mixtures thereof.

3. The apparatus as defined in claim 1 wherein the amount of oxidizer is that amount necessary to oxidize carbon in said energetic binder system to carbon dioxide.

4. The apparatus as defined in claim 1 wherein the weight percent of said oxidizer is from about 55% to about 80% based on the combined weight of said energetic binder system and said oxidizer.

5. The apparatus as defined in claim 2 wherein said oxidizer is phase stabilized ammonium nitrate and wherein the weight percent of said phase stabilized ammonium nitrate is about 21% and the weight percent of said copolymer of bis-3,3-nitratomethyl-oxetane and nitratomethyl-methyl-oxetane is about 79%.

6. The apparatus as defined in claim 1 wherein said energetic binder system is a resilient solid capable of withstanding shock without permanent deformation at 85° C. and non-brittle at −40° C.

7. The apparatus as defined in claim 1 wherein said gas generating composition consists essentially of an oxidizer and an energetic binder system.

* * * * *